United States Patent [19]

Powers

[11] 3,963,481

[45] June 15, 1976

[54] PROCESS FOR COOLING SINTER ON THE STRAND

[75] Inventor: Robert E. Powers, Pittsburgh, Pa.

[73] Assignee: Koppers Company, Inc., Pittsburgh, Pa.

[22] Filed: Mar. 3, 1975

[21] Appl. No.: 555,061

[52] U.S. Cl. ..... 75/5; 75/3

[51] Int. Cl.[2] ..... C22B 1/24; C22B 1/08

[58] Field of Search ..... 75/3–5

[56] References Cited

UNITED STATES PATENTS

| | | | |
|---|---|---|---|
| 3,003,863 | 10/1961 | Meyer | 75/5 |
| 3,285,735 | 11/1966 | Phelps | 75/5 |
| 3,383,199 | 5/1968 | Schmidt | 75/5 |
| 3,501,288 | 3/1970 | Krainer | 75/5 |
| 3,649,244 | 3/1972 | Cunningham | 75/5 |

*Primary Examiner*—Peter D. Rosenberg
*Attorney, Agent, or Firm*—Sherman H. Barber; Olin E. Williams; Oscar B. Brumback

[57] ABSTRACT

In a sintering process a sinter mix containing solid fuel is fed in a layer onto a traveling-grate type of sintering machine. The fuel in the layer is ignited and it burns downwardly under downdraft air to form a resulting solid sinter cake. The sinter cake has an upper portion of sinter that is cool enough to be conveyed on a rubber conveyer belt. The lower portion of the sinter contains a fire zone.

A sinter cake cutter or plow separates along a horizontal plane the cool upper portion of sinter cake and removes it, while the remainder of the sinter containing the fire zone travels along on the strand. The lower portion of the sinter is cooled by updraft air which is recycled into the burning zone.

6 Claims, 3 Drawing Figures

PROCESS FOR COOLING SINTER ON THE STRAND

BACKGROUND OF THE INVENTION

Interest in the process for cooling sinter in situ on the sinter machine without first breaking and screening the sinter cake has increased to the point where it is commercially important to improve existing technology in this art. The art of first breaking and screening the sinter cake is old, but plants incorporating this art in some form, which were constructed in times past both in the United States and abroad, have experienced poor operating results.

A typical plant has a long sintering strand on which sintering and cooling are carried out in succession, utilizing separate fan systems. The sintering and the cooling portions of the strand are separated by a dead plate which acts as a seal to isolate one fan system from another fan system.

In accordance with present sintering practice, cooling of the sinter is effected by down draft. The sintering portion includes a hearth layer of screened sinter placed on the grates to protect and partially insulate them. Onto the hearth layer, a layer of sinter mix is deposited and the mix is ignited as it passes under an ignition burner. As the strand carrying the burning sinter passes along, it is subjected to a downdraft of air which enhances down-burning in the sinter mix. The bottom of the fire zone of burning sinter reaches the hearth layer just as the strand reaches the dead plate and crosses into a cooling portion.

The cooling portion in conventional practice provides downdraft of sufficient intensity to cool the sinter cake completely; that is to say, to such an extent that the sinter cake when discharged in broken form can be handled safely by rubber belt conveyors.

Although there are a number of advantages to this type of strand cooling, there are also a number of disadvantages. First, the sinter strand and the building housing the machine must be very long, and in such a long machine the lower or return run performs no useful function. This kind of machine is very costly initially and is costly to service and maintain. Second, a long sintering machine generally does not track properly and this can potentially increase wear and require extra maintenance on machine parts, such as wheels, rails, and the sinter pallets. Third, the downdraft cooling pulls all of the heat in the sinter cake down through the machine pallets. The increased heat on the grate bars and the pallet ribs causes these parts to deteriorate or else requires that they be constructed more ruggedly than they need be if another type of cooling were used. Pertinent prior art includes patents: U.S. Pat. No. 3,172,754 to J. A. Anthes, et al. (Anthes); U.S. Pat. No. 3,166,403 to A. M. Schwarz (Schwarz); and U.S. Pat. No. 2,174,066 to N. Ahlmann (Ahlmann).

U.S. Pat. No. 3,172,754 to Anthes relates to a process and apparatus for heat-hardening green pellets of ore by firing them for use in blast furnaces. Although Anthes uses the term "sintering strand", the object to which he applies such term is a traveling grate. A traveling grate is not a sinter strand on which is placed a mixture of ore and solid fuel which is ignited to produce a hard coherent agglomerated sinter cake.

As described in Anthes, heat indurated pellets, whether or not they contain solid fuel, produce discrete hardened pellets and the process is desirably so controlled that caking or adhesion of the pellets does not occur.

Heat hardening of the pellets is performed by downdraft and the bed of pellets then moves immediately over an updraft cooling zone where the pellets are cooled. Hot air above the cooling zone is conducted back to be recuperated by passing through the downdraft indurating zone.

Anthes does not state the temperature of the pellets when they enter the cooling zone, but it is significant to note that he mentions "highly heated" air, probable way over 1000°F. This air, which is too hot to be handled by a fan, contacts the top of the pellet bed right up to the end of the hardening zone. In Anthes, not only is the average temperature of the bed of hardened pellets high, but also the temperature of the top layer of the bed is high.

This situation is quite different from that in the sinter mix bed as described and claimed in the present invention. The temperature differences, among other things, between Anthes and the present invention are patentably distinct, as is the fact that Anthes relates strictly to indurating pellets of ore and not to indurating a sinter mix.

U.S. Pat. No. 3,166,403 to Schwarz relates to sintering of iron ore, a fluxed iron ore sinter product having a low arsenic content from iron ore containing a relatively high percentage of arsenic. Schwarz shows apparatus for sintering iron ore in a bed that is formed of a plurality of distinct and separable layers. At least two distinct horizontally disposed layers of sintering material are superimposed on a continuously moving sinter grate, one of the layers being an acid, or flux-free iron ore sinter mix, and the other layer being a fluxed iron ore sinter mixture.

The spaced apart upper and lower layers are formed of iron ore sinter feed mixture, each one having a different chemical composition from the other. An intermediary layer of metallurgically useful material is disposed between the upper and lower layers, but it does not fuse with itself or the other layers at the sintering temperatures.

Schwarz deals entirely with sintering; there is no teaching of cooling the sinter cake in the patent. Hence, the teaching and claimed present invention is patentably distinct and unobvious from Schwarz.

U.S. Pat. No. 2,174,066 to Ahlmann relates to sintering or calcining of material such as cement raw materials. On a travelling grate a first layer of recuperative material is spread and over this is a layer of material to be sintered or calcined. The layer to be sintered or calcined contains fuel which is ignited so that it burns in a firing zone, and sinters or calcines the material.

When the burning ceases under the influence of downdraft the sinter is cut off by means of a plough or curved metal plate, leaving only the recuperative layer on the grate. Air passing upwardly through the recuperative layer cools it and the air is heated. The hot air is then directed into a preheating zone, before the ignition or firing zone. In Ahlmann, the sinter cake is not cooled by updraft, but is subject only to downdraft. The downdraft enhances the burning which is completed by the time the sinter cake reaches a dead plate zone wherein it is removed by the plough or curved metal plate.

That Ahlmann does not cool the sinter cake by updraft means is a significant and patentable difference between Ahlmann and the present invention.

BRIEF SUMMARY OF THE INVENTION

A sinter mix combined with a fuel is continuously deposited on grate bars of moving sinter conveyor units. The fuel is ignited in an ignition zone and air flows downwardly through the mix to induce burning of the fuel and sintering in an indurating zone. A portion, already cooled, of the sinter cake is removed and carried away. The remaining sintered material is subjected to updraft air cooling. The air, being heated, is collected and recycled into the indurating zone.

It is an object of the invention to shorten the cooling section of the strand to thereby decrease the cost of the sintering strand and the building housing it. The problems of tracking experienced in long strands of the prior art are thereby materially reduced.

It is an object of the invention to decrease significantly the heat load on the sintering pallets by using updraft cooling.

It is an object of the invention to provide preheated air to the sinter mix, thereby reducing the fuel required for sintering, improving the strength of the sinter structure, and eliminating dust collecting equipment for air from the cooling section.

It is an object of the invention to remove sinter which has already cooled from the other sinter that must be cooled in the cooling section.

It is an object of the invention to provide a layer of material between upper and lower layers of sinter mix that does not itself sinter and that forms a plane of weakness in the sinter cake so that the upper sintered layer, when cooled, can be removed from the lower layer cooled by updraft air circulation.

For a further understanding of the invention and for features and advantages thereof, reference may be made to the following description and the drawing which illustrates a preferred embodiment of equipment in accordance with the invention which is suitable for practicing the method of the invention.

DETAILED DESCRIPTION

Figure 1:
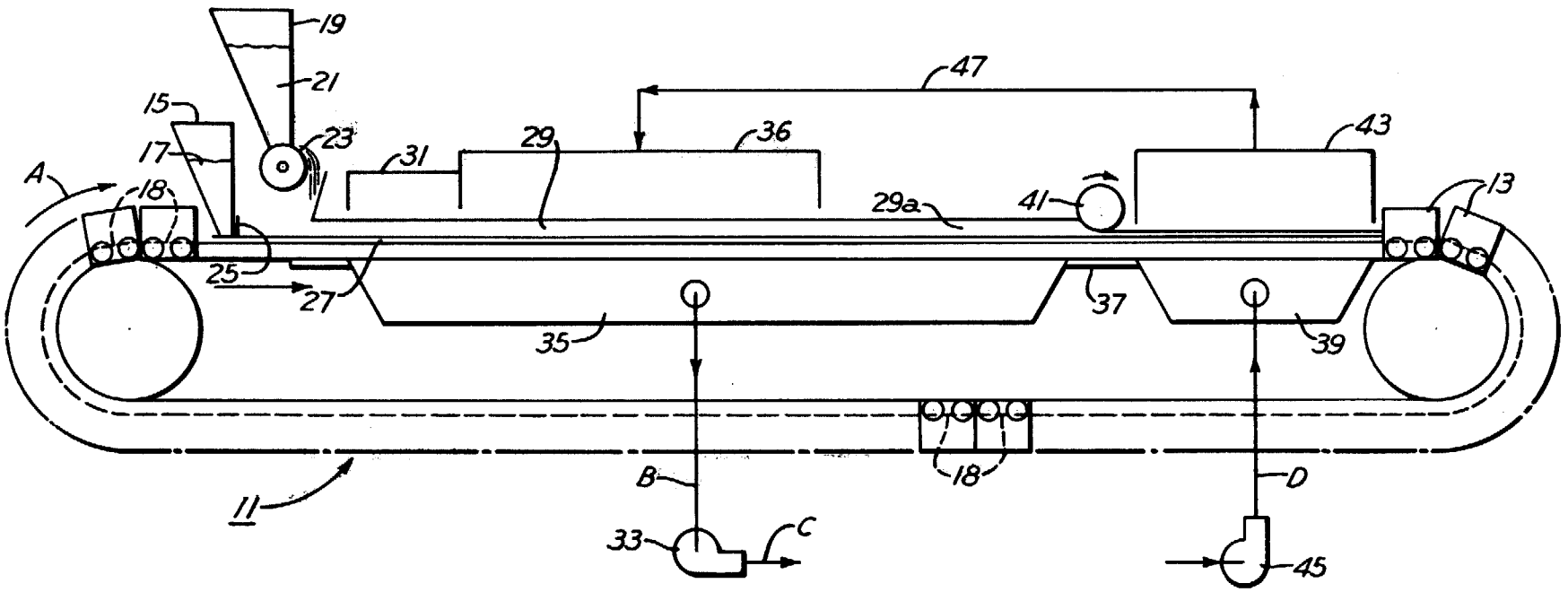
FIG. 1 is a schematic view of a sintering machine in accordance with the invention that is suitable for carrying into practice the method of the invention.

Referring to FIG. 1, it shows schematically a sintering apparatus 11 in accordance with the invention that is suitable for carrying into practice the method of the invention. Those skilled in the art will understand that details of construction of such sintering machine and the manner of constructing and moving the pallets are omitted, as these details conform to present well-known construction and practice in the art. A suggestion of conventional pallets 13 is shown in the drawing, and they move from left to right in the direction of arrow A.

As the pallets 13 pass beneath a hearth-layer feed bin 15 containing screened sinter 17, the screened sinter is deposited upon grate bars 18 of each pallet as a hearth layer. This hearth layer protects the grate bars 18 to a certain extent during the sintering process.

Thereafter, the pallets 13 pass beneath a sinter mix feed bin 19 containing sinter mix 21, and the sinter mix, comprising screened iron ore and coke breeze, is deposited on top of the hearth layer of screened sinter 17. As shown in FIG. 1, a conventional roll feeder 23, which is one type of flow regulating device that can be used, controls the flow of sinter mix from the feed bin 19. A cut-off plate 25 is installed at the feed bin 15 outlet to control the flow and to regulate the thickness of the screened sinter 17 on the pallet grate bars 18.

In FIG. 1, the screened sinter 17 forms a hearth layer, designated by reference numeral 27, and the sinter mix forms a layer, designated by the reference numeral 29.

The pallets 13 move from left to right as viewed in FIG. 1 and, after being loaded with hearth layer material 27 and sinter mix material 29, pass under an ignition hood 31 of conventional type. The sinter mix, containing the coke breeze, is ignited in the ignition hood 31 and the coke breeze burns as air is pulled into the hood and through the sinter mix layer 29 in a downdraft manner, as shown by arrow B. The downdraft is created by fan 33 pulling air down through the sinter layer 29, the hearth layer 27, and the grate bars 18 into a conventional wind box structure 35. Thereafter, the air, containing any fine particulate sinter material, discharges in the direction of the arrow C.

Burning of the sinter layer 29 continues during the time the pallets 13 move toward the right and pass under an indurating hood 36. By the time the pallets 13 reach the right-hand end of the wind boxes 35, the bottom of the fire zone of burning sinter reaches the hearth layer just as the strand reaches the dead plate 37 and the indurated sinter mix 21 becomes a hard flat sinter cake 29*a*.

At the right-hand end of the wind boxes there is a conventional dead plate 37 (shown also in FIG. 2) over which the pallets 13 travel. The dead plate 37 is impervious to the flow of air and it serves to separate the downdraft flow of air in the sintering section from an updraft flow of air in a cooling section 39.

Above the dead plate 37 is a rotary sinter cutter 41 that is of conventional design. The sinter cutter 41 removes the already cooled top portion of sinter cake 29*a*, whereby cooling of the remaining thickness of indurating sinter mix is more easily effected.

Above the updraft cooling section 39 is a hood 43 that collects updraft flowing air which is heated as it passes through the remaining thickness of indurating sinter mix. The air flows updraft in the direction of arrow D, being generated by a fan 45. The heated updraft flowing air collected in the hood 43 is carried by conduit 47 from the hood 43 to the indurating hood 36. The effect is that it is not necessary to provide dust collecting equipment for the heated air removed from the hood 43.

It is preferred to operate the apparatus in accordance with the method of the invention with a conventional hearth layer and a sinter mix layer. However, in some instances where the sinter material is especially abrasive, it is possible to assist the sinter cake cutter by creating a plane of weakness within the sinter cake. This may be most easily done by providing a layer of sized sinter or other suitable material between first and second layers of sinter mix; the first layer of sinter mix being placed on top of the hearth layer.

Figure 3:
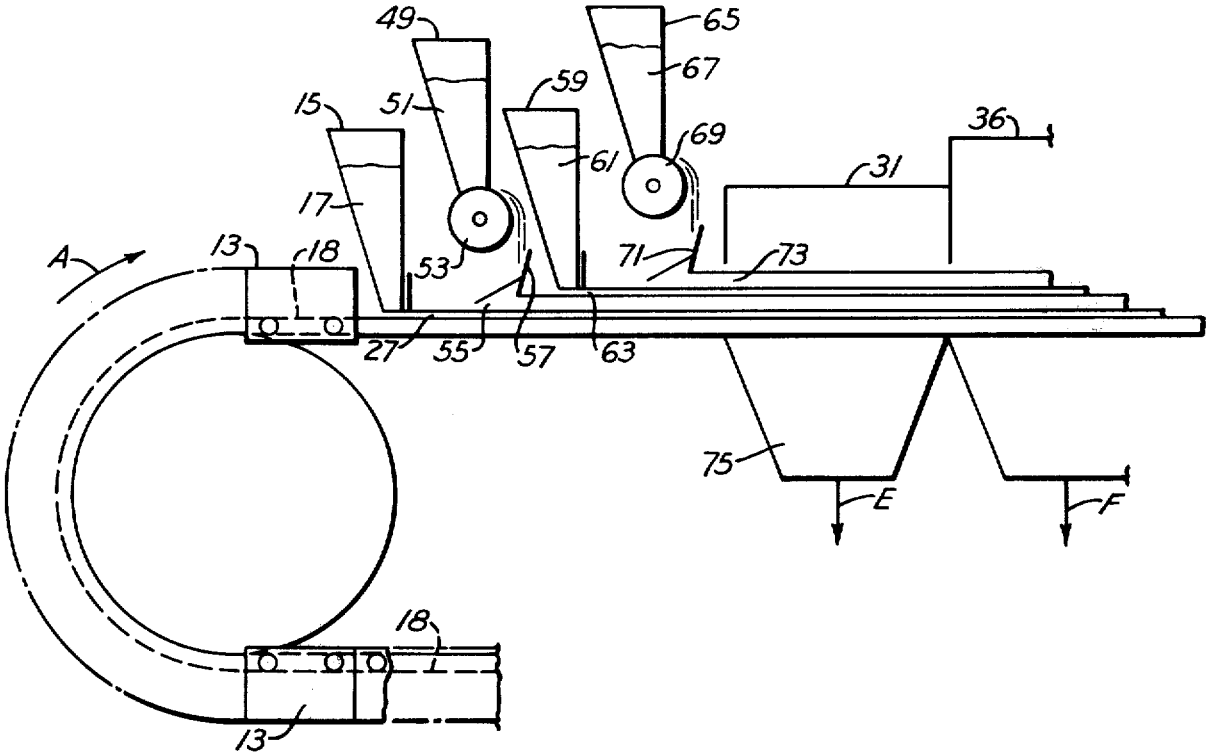
FIG. 3 is a schematic view at an enlarged scale of a portion of apparatus like that of FIG. 1, but showing a modification thereof.

FIG. 3 shows schematically apparatus for effecting the plane of weakness in the sinter cake. Pallets 13 traveling in the direction of the arrow A (same as in FIG. 1) first pass beneath the hearth-layer feed bin 15 containing screened sinter 17 which is deposited upon the grate bars 18 of each pallet as the hearth layer 27. Thereafter, the pallets pass beneath a first sinter mix feed bin 49 containing sinter mix 51. This material, comprising screened iron ore and coke breeze, passes through a conventional roll feeder 53 and gravitates onto the hearth layer 27 as a first sinter mix layer 55. A cut-off plate 57 is so positioned that the thickness of the first sinter mix layer is predetermined.

Another feed bin 59 containing the material 61 of the intermediary layer is positioned near the feed bin 49. Then, as the pallets 13 move along the machine in the direction of arrow A, they pass beneath the feed bin 59 and the material 61 is deposited on top of the first sinter mix layer 55 as an intermediary layer 63. The intermediary layer is relatively thin; say one or two inches thick.

Adjacent the feed bin 59 is a fourth feed bin 65 containing the same type of sinter mix material 67 which flows from the feed bin 65 through a roll feeder 69. The sinter mix material 67 contacts a cut-off plate 71 and is thereby leveled as a second or upper sinter mix layer 73 on the sinter machine.

The pallets 13 continue their progression from left to right, as viewed in FIG. 3, and, after being loaded with hearth layer material 27, first 55, second 73 and intermediary 63 layers of material as described previously, pass beneath an ignition hood 31 and an indurating hood 36 like those shown and described in connection with FIG. 1. There are conventional wind boxes 75 disposed beneath the sinter track and the indurating sinter material 55 and 73 which is subjected to downdraft in the direction of the arrows E and F.

Figure 2:
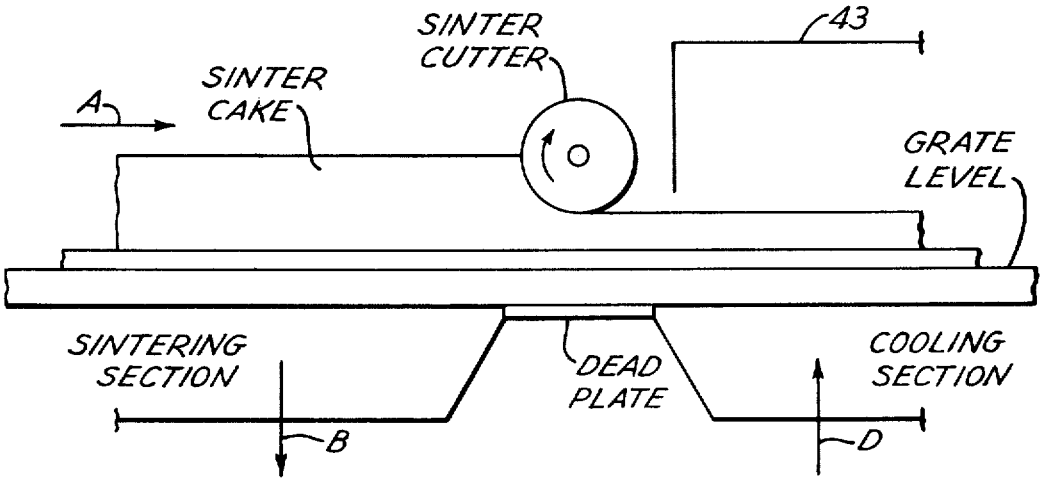
FIG. 2 is a schematic view of a portion of the apparatus of FIG. 1 at an enlarged scale.

Those skilled in the art will understand that the sinter cutter 41 of FIG. 1 may be used in the embodiment of the invention shown in FIG. 2. In which event, the sinter cutter 41 removes the entire second or upper layer of sinter cake material 73.

In a tyical sintering machine of the present invention operated in accordance with the method thereof, the sinter cake has an upper portion of sinter about 4 or 5 inches thick that is cooled sufficiently, to a temperature below 250°F, to be safely carried away on rubber belt conveyors. The lower portion of sinter cake, however, which is about 7 or 8 inches thick has an average temperature of 1200°–1300°F, and contains a fire zone about 2 to 4 inches thick which is at a temperature of about 2,400°F. The intermediary layer, as mentioned previously, has a thickness in the range of 1 to 2 inches.

From the foregoing description of one embodiment of the invention, those skilled in the art should recognize many important features and advantages of it, among which the following are particularly significant:

That no conventional sinter breaker, hot screen or separate sinter cooling equipment is required as accessories to the apparatus of the present invention;

That improved environmental conditions at the machine discharge are achieved by operating the apparatus of the present invention;

That with updraft cooling of the sinter, the heat of indurating does not unduly affect the grate bars and the pallet structure;

That cleaning of the cooling air used in the apparatus is not required is an economical benefit not achieved with conventional apparatus; and That the cooling time is shorter; there is a lower pressure drop of cooling air in the apparatus; and that the recycle gas is hotter and has a smaller volume.

Although the invention has been described herein with a certain degree of particularity it is understood that the present disclosure has been made only as an example and that the scope of the invention is defined by what is hereinafter claimed.

What is claimed is:

1. A process for preparing a sintered product comprising the steps:

a. continuously depositing on gas-permeable moving sintering conveyor units a hearth layer of screened sinter;

b. continuously depositing on said hearth layer a layer of material to be sintered mixed with a fuel;

c. igniting said fuel;

d. inducing downdraft burning of said fuel in a burning zone whereby said material becomes progressively sintered;

e. removing a portion of the material after it has become sintered;

f. thereafter passing a gas upwardly through the remaining indurating material to cool the same; and g. conducting said gas after it has passed through the material into said burning zone.

2. The invention of claim 1 wherein:

a. said fuel is coke breeze; and b. a fan induces said downdraft.

3. The invention of claim 1 wherein:

a. removing said material is accomplished by cutting said sintered material.

4. A process for preparing a sintered product comprising the steps:

a. continuously depositing on gas-permeable moving sintering conveyor units material to be sintered mixed with a fuel;

b. igniting said fuel;

c. inducing downdraft burning of said fuel in a burning zone whereby said material becomes progressively sintered;

d. removing a portion of said material that has become sintered; and e. inducing updraft cooling of the remaining material.

5. A process for preparing a sintered product comprising the steps:

a. continuously depositing on gas-permeable moving sintering conveyor units a first layer of material to be sintered mixed with fuel;

b. continuously depositing on said first layer of the mixed material a second layer of sized material that does not sinter and does not fuse to said mixed material;

c. continuously depositing on said second layer of sized material a third layer of material to be sintered mixed with a fuel;

d. igniting the fuel in said third layer;

e. inducing a downdraft flow of air through said layers of mixed materials so that said first and third layers of mixed material are sintered in a burning zone;

f. removing said third layer of sintered material;

g. inducing an updraft flow of air through said first layer of sintered material and said intermediary layer thereby cooling the remaining layers; and h. collecting the updraft flowing air and conducting it into said burning zone.

6. The invention of claim 5 wherein:

a. removing said third layer is accomplished by separating it from said intermediary layer.

* * * * *